US005192062A

United States Patent [19]

Berchtold

[11] Patent Number: 5,192,062

[45] Date of Patent: Mar. 9, 1993

[54] CLAMPING FORCE ADJUSTING DEVICE FOR A CLAMP DEVICE

[75] Inventor: Heinrich Berchtold, Nänikon/Uster, Switzerland

[73] Assignee: Gressel AG, Aadorf, Switzerland

[21] Appl. No.: 869,628

[22] Filed: Apr. 16, 1992

[30] Foreign Application Priority Data

Apr. 17, 1991 [DE] Fed. Rep. of Germany ..... 4112547

[51] Int. Cl.[5] ..... B25B 1/10

[52] U.S. Cl. ..... 269/244; 269/228

[58] Field of Search ..... 269/32, 24, 244, 228; 74/110, 516

[56] References Cited

U.S. PATENT DOCUMENTS

| | | | |
|---|---|---|---|
| 3,095,190 | 6/1963 | Freund | 269/32 |
| 3,650,522 | 3/1972 | Wermuth et al. | 269/228 |
| 3,807,721 | 4/1974 | Arnold | 269/228 |
| 4,046,364 | 9/1977 | Coope et al. | 269/244 |
| 4,418,899 | 12/1983 | Zimmermann et al. | 269/32 |
| 4,599,719 | 10/1985 | Baumann | 269/32 |
| 4,940,216 | 7/1990 | Pluger | 269/32 |

*Primary Examiner*—Robert C. Watson

*Attorney, Agent, or Firm*—Flynn, Thiel, Boutell & Tanis

[57] ABSTRACT

The clamping force adjusting device for a clamp device comprises a hollow housing (1) supported on a movable clamping part of the same, through which housing passes a rotatable and slidable tension rod (5), whose first end can be coupled to a force amplifier and whose second end (5*b*) carries a tension sleeve (6) fixed thereon. The tension sleeve (6) is supported on Belleville springs (9) through a thrust bearing (8) and an intermediate sleeve (b 10), the Belleville springs being supported directly in the housing (1). An adjusting sleeve (13) screws into a fine thread (14) of the housing (1) and has at its end facing the Belleville springs (9) a radially inwardly directed first stop shoulder (16), which cooperates with a radially outwardly directed second stop shoulder (17) of the intermediate sleeve (10) and/or a spacer ring (18) bearing on the thrust bearing (8).

11 Claims, 2 Drawing Sheets

CLAMPING FORCE ADJUSTING DEVICE FOR A CLAMP DEVICE

FIELD OF THE INVENTION

This invention relates to a clamping force adjusting device for a clamp device, especially a machine vise, with a hollow housing supported directly or indirectly on a movable clamp part (jaw) of the same, which housing is formed if desired as a hand grip connected to a screw spindle, with a tension rod passing through the housing and rotatable and slidable relative thereto, the first end of the tension rod being capable of coupling to a force amplifier and its second end carrying a tension sleeve provided with an abutment flange and fixed on this end, the tension sleeve for its part acting axially on the housing through an adjusting sleeve axially adjustable by means of a fine thread, a thrust bearing and a plurality of Belleville springs.

BACKGROUND OF THE INVENTION

In such a clamping force adjust device (cf. prior German patent 4 018 284, corresponding to U.S. application Ser. No. 07/706,797, filed May 29, 1991 now U.S. Pat. No. 8,171,004, the housing is connected to a hollow spindle and formed as a hollow hand grip. The screw spindle engages in the movable jaw of a machine vise. The screw spindle is of hollow form and a tension rod is passed therethrough, with its first end connected to a force amplifier arranged below the fixed jaw. The adjusting sleeve is adjustable through a fine thread on the end of the tension sleeve facing the second end of the tension rod. The adjusting sleeve abuts the Belleville springs directly, these in turn abutting a thrust bearing. This thrust bearing furthermore lies on one side on the abutment flange of the tension sleeve and on the other side on the housing also. By rotating the adjusting sleeve relative to the tension sleeve the pre-tension of the Belleville springs changes and the desired clamping force can thus be preset. Especially with large clamp devices with a maximum clamping force of 40 kN or more, the spring force of the Belleville springs is however so great that a tool, for example, an open-ended spanner, is needed to adjust the adjusting sleeve and the adjustment can still only be effected with considerable effort.

The invention is therefore based on the problem of providing a clamping force adjusting device for a clamp device, especially a machine vise, of the kind initially referred to, in which the clamping force can be adjusted easily in the unstressed state by hand and without tools.

This is achieved according to the invention in that the abutment flange is provided on the end of the tension sleeve adjoining the second end of the tension rod and the thrust bearing is provided on the side of the abutment flange facing away form the second tension rod end, in that the Belleville springs are supported directly in the housing, in that an intermediate sleeve is provided between the Belleville springs and the thrust bearing, abutting the thrust bearing on one side and abutting the Belleville springs on the other side, and in that the adjusting sleeve can screw into a fine thread of the housing and has a radially inwardly directed first stop shoulder on its end facing the Belleville springs, this shoulder so cooperating with a radially outwardly directed second stop shoulder of the intermediate sleeve and/or a spacer ring bearing on the thrust bearing that the axial spacing of the first stop shoulder from the second stop shoulder or from the spacer ring is adjustable in the unstressed state by screwing the adjusting sleeve relative to the housing, whereby the stroke of the intermediate sleeve which this performs on tightening up to abutment of the first stop shoulder on the second stop shoulder or the spacer ring is adjustable.

Since the adjusting sleeve abuts neither the thrust bearing nor the Belleville springs in the unstressed state of the clamp device in the novel clamping force adjusting device, no axial forces act in the unstressed state. As a result the adjusting sleeve can be turned easily by hand without tools to alter the clamping force and thus easily adjust to the desired clamping force. This clamping force can be read easily off a scale applied to the adjusting sleeve. On adjusting to a minimum clamping force, the first stop shoulder has the greatest spacing from the second stop shoulder or the spacer ring. This spacing corresponds to at least the tightening stroke of the force amplifier. In the tightening stroke of the force amplifier the tension rod is so moved through the housing that ht tension sleeve approaches the Belleville springs. Through this the tension sleeve compresses the Belleville springs through the thrust bearing and the intermediate sleeve. The clamping force corresponds them to the spring force created by the compression of the Belleville springs. If the adjusting sleeve is on the other hand rotated relative to the housing for maximum clamping force, it moves the inwardly directed first stop shoulder with this adjustment of the clamping force up to the second stop shoulder or the spacer ring and comes into abutment therewith. Through this no mutual axial movement of the intermediate sleeve and the tension sleeve relative to the adjusting sleeve is possible in the tightening stroke of the force amplifier. The whole axial force transmitted to the tension rod in the tightening stroke of the force amplifier is transmitted directly from the tension sleeve through the thrust bearing and from this through the second stop shoulder or the spacer ring to the abutment shoulder of the adjusting sleeve and thence through the fine thread to the housing. The tightening stroke of the force amplifier leads to elastic deformation of the various components of the clamp device participating in the clamping, such as the tension rod, screw spindle, jaws and body of the clamp device. If the adjusting sleeve is set to a position between the maximum and minimum clamping forces, the spacing between its stop shoulder and the stop shoulder of the intermediate sleeve or the spacer ring is smaller than the tightening stroke of the force amplifier. In this case the belleville springs are firstly compressed to a certain extent in the tightening stroke, whereby a certain spring force is created. Then the stop shoulder of the adjusting sleeve comes int abutment with the stop shoulder of the intermediate sleeve or the spacer ring and the remaining, residual tightening stroke of the force amplifier now effects the elastic deformation of the components participating in the clamping. Since however the remainder of the tightening stroke is smaller than the maximum tightening stroke, a clamping force between the maximum and minimum clamping forces results.

BRIEF DESCRIPTION OF THE DRAWINGS

The invention is explained in more detail below, with reference to an embodiment shown in the drawings. These show.

DETAILED DESCRIPTION

Figure 3:
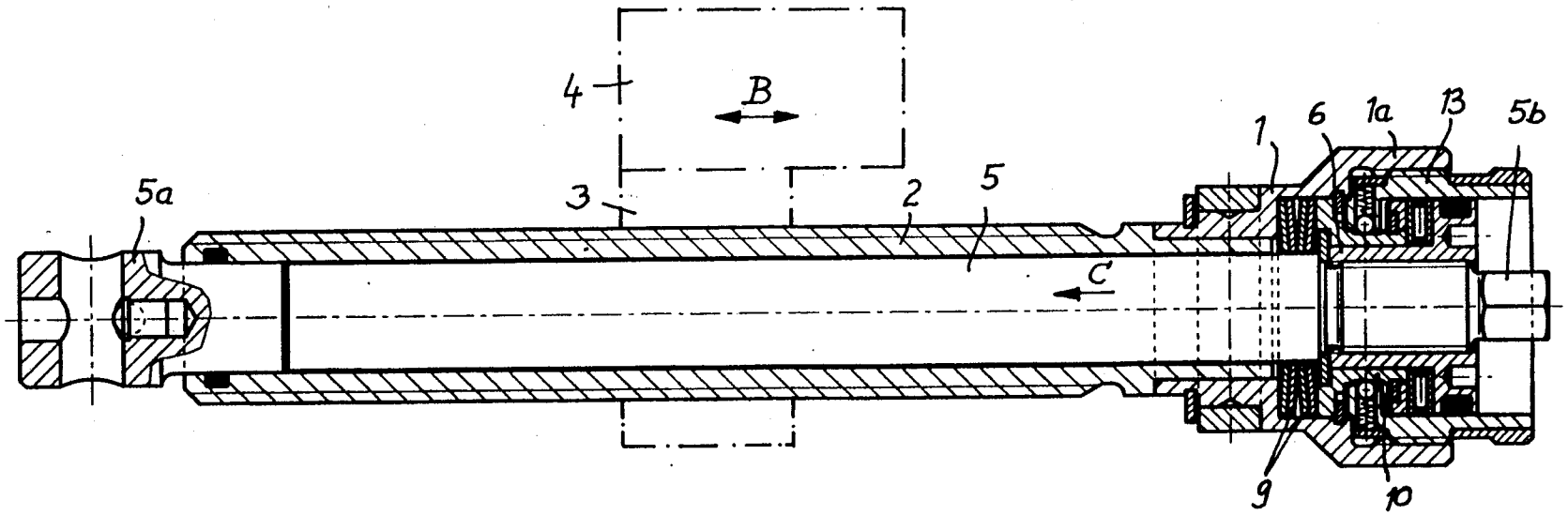

The clamp device comprises a hollow housing 1, which is formed as a hand grip 1*a* in the illustrated embodiment and can be connected fast rotationally and in tension with a screw spindle 2. This screw spindle 2 engages, as is apparent from FIG. 3, in a spindle nut 3, which can be connected to the movable jaw 4 of a vise. In the hollow screw spindle 2 there is arranged rotatably and axially slidable a tension rod 5, whose first end 5*a* can be connected to a force amplifier, not shown. This force amplifier can be arranged below the fixed jaw of a machine vice and is actuated for example by rotation of the tension rod 5, similar to what is described in German patent 4 018 284. By rotating the screw spindle 2 by means of the hand grip 1*a*, the adjustable jaw can be adjusted in the direction B, so that the clamping capacity of the machine vise can be set. If the clamping force adjusting device is used in a clamp device with a predetermined clamping capacity, the hollow screw spindle 2 is dispensed with. In this case the housing 1 directly abuts the movable jaw 4.

The tension rod 5 is passed through the housing 1. A tension sleeve 6 is screwed or otherwise fixed on its second end 5*b* located inside the housing 1. The tension sleeve 6 has an abutment flange 7 at its end adjacent the second end 5*b*. A thrust bearing 8 is supported on the side of this abutment flange facing away from the second end 5*b*. A plurality of Belleville springs 9 are supported directly in the housing 1 at its end 1*b* facing the movable jaw 4. In between the Belleville springs 9 and the thrust bearing 8 is arranged an intermediate sleeve 10, sufficient play being provided between this intermediate sleeve 10 and the tension sleeve 6 for the tension sleeve 6 to be able to rotate relative to the intermediate sleeve 10.

At its end facing the Belleville springs 9 the intermediate sleeve 10 has a radially outwardly direction flange 11 bearing on the Belleville springs 9. The flange 11 is retained axially by a retaining ring 12 (circlip) fitted in an annular groove on the side facing away from the Belleville springs 9. The retaining ring 12 can be so arranged that the Belleville springs 9 are already prestressed to a desired degree on fitting the flange 11 and the retaining ring 12.

There is further provided an adjusting sleeve 13, which screws axially into the housing 1 by means of a fine thread 14, more precisely into the housing part 1*a*. The adjusting sleeve 13 carries a scale ring 15. Furthermore the adjusting sleeve 13 has a radially inwardly directed stop shoulder 16 at its end located inside the housing 1. This first stop shoulder 16 cooperates with a second stop shoulder 17 provided on the intermediate sleeve 10 and/or with a spacer ring 18, which bears on the thrust bearing 8. For assembly reasons the second stop shoulder 17 on the intermediate sleeve 10 is advantageously formed by a retaining ring 17 fitted in an annular groove of the same. This retaining ring 17 is partially surrounded by the spacer ring 18, the arrangement being such that the axial thickness of the spacer ring 18 corresponds to the distance which the side of the retaining ring facing the first stop shoulder 16 has from that end of the intermediate sleeve 10 which bears on the thrust bearing 8.

In order to obtain uniform transmission of force from the spacer ring 18 and the retaining ring 17 to the first stop shoulder 16, a washer 19 can be provided covering the retaining ring 17 and the spacer ring 18.

Since the adjusting sleeve is not acted on by the Belleville springs 9 in the unstressed state of the clamping force adjusting device, it can be rotated relative to the housing 1 very easily. In order to avoid unwanted movement of the adjusting sleeve 13 and to secure it in its currently set rotational position relative to the housing, two radial bores 20 are provided in the stop shoulder 16 of the adjusting sleeve 13. In each of these bores there are arranged a compression spring 21 and a detent ball 2. The bores 20 are closed radially outwardly by a ring 23 surrounding the adjacent sleeve 13. The outer peripheral surface of the intermediate sleeve 10 is provided with a plurality of axial grooves 24 spaced from one another in the peripheral direction, serving to engage with the detent balls 22. Instead of this locking device operation stepwise, a friction ring (brake ring) could be provided between the adjusting sleeve 13 and intermediate sleeve 10 or even the hollow hand grip 1*a*, this then making possible stepless adjustment of the adjusting sleeve 13 relative to the housing 1.

Figure 1:
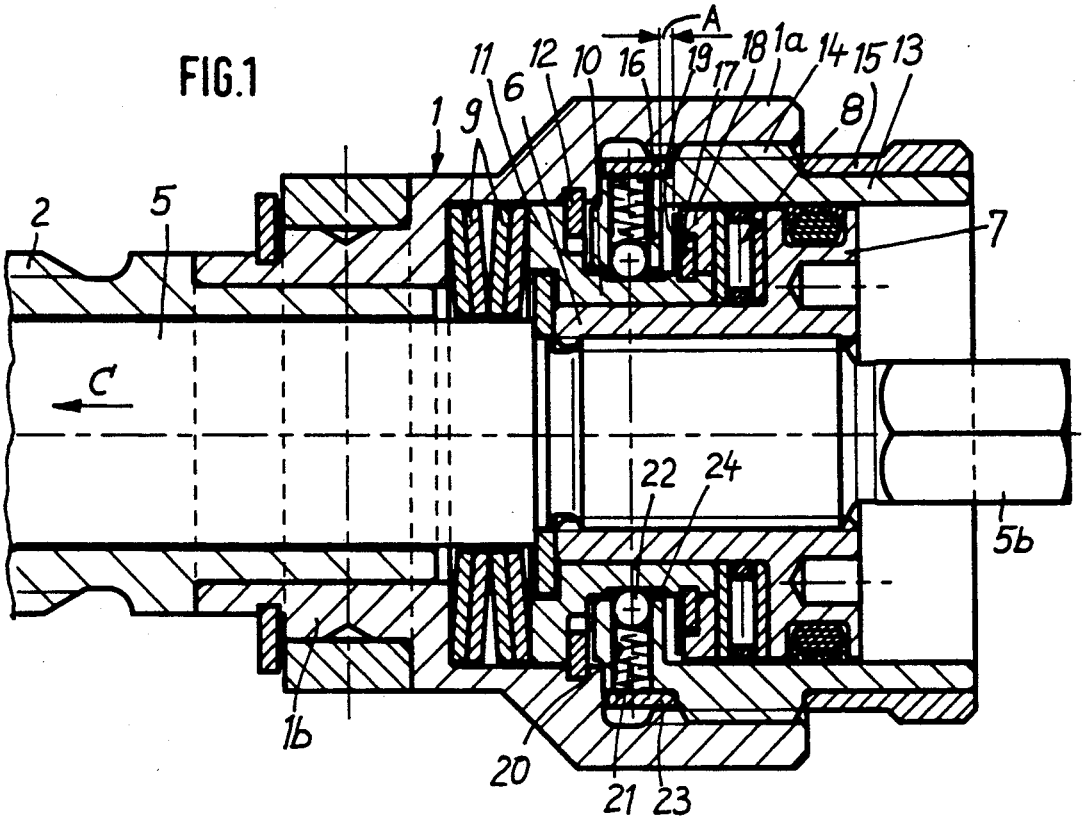
FIG. 1 an axial section through the clamping force adjusting device for minimum adjusted clamping force, FIG. 2 an axial section at maximum adjusted clamping force but in unstressed state, FIG. 3 an axial section of the clamp device with screw spindle and complete tension rod.

The manner of operation of the clamping force adjusting device is as follows:

The clamp device is shown in FIG. 1 with minimum clamping force set in the unstressed state. The adjusting sleeve 13 is here screwed so far into the housing 1 that a spacing A is provided between the fist stop shoulder 16 and the washer 19 which is somewhat greater than the maximum tightening stroke of the force amplifier. The force amplifier, not shown, can be actuated by rotation of the tension rod 5 by means of a hand grip fitted to its end 5*a*. In the tightening stroke of the force amplifier, the tension rod 5 moves relative to the housing 1 in the direction C, this tightening stroke amounting however to only about 1 to 1.5 mm. Through this the tension rod carries the tension sleeve 6 fixed thereon with it to the left. Through the thrust bearing 8 as well a the intermediate sleeve 10 and its flange 11, the Belleville springs 9 are compressed. However, with the full tightening stroke, the washer 19 does not come into abutment with the stop shoulder 16 at the minimum clamping force setting. The Belleville springs 9 press the housing 1 and thus the screw spindle 2 also and the jaw 4 to the left with a clamping force which corresponds to the spring force generated by the compression of the Belleville springs 9.

Figure 2:
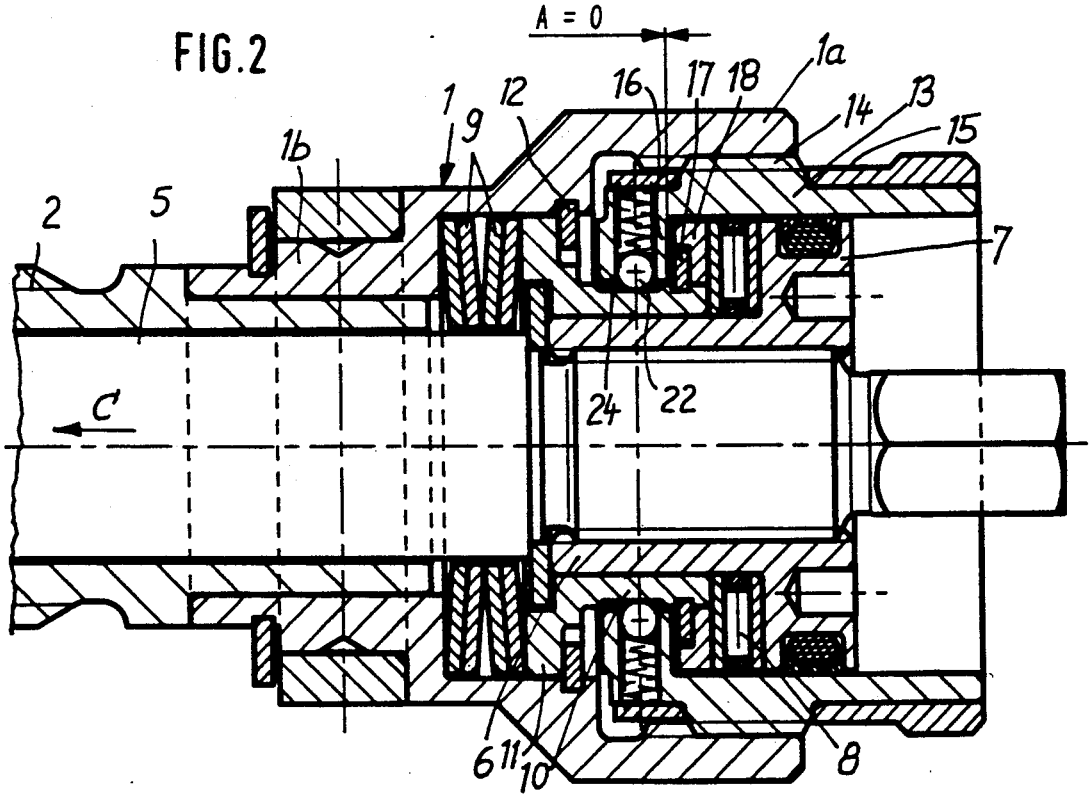

In FIG. 2 the clamp device is shown adjusted for maximum clamping force. For this the adjusting sleeve 13 is screwed so far to the right relative to the housing 1 that its stop shoulder 16 bears on the washer 19 and there is thus direct application of force between the abutment flange 7 and the stop shoulder 16, with interposition of the thrust bearing 8, the spacer ring 18, the retaining ring 187 and the washer 19. If now the tension rod 5 is drawn in the direction C during the tightening stroke, the transmission of force is effected from the tension sleeve 6, through the last-mentioned parts to the stop shoulder 16 of the adjusting sleeve 13 and from this through the fine thread 14 to the housing 1. In this case the Belleville springs 9 are not stressed by tightening force. The tightening stroke of the force amplifier leads to elastic deformation of the vice components participating in the clamping, such as the tension rod 5, spindle 2, spindle nut 3, movable jaw 4, fixed jaw and vise base member. In this manner the desired high clamping force of for example 40 kN can be created.

To preset an intermediate clamping force lying between the minimum and maximum clamping forces, the adjusting sleeve 13 is rotated to a rotational position relative to the housing 1 in which the distance A between its stop shoulder 16 and the washer 19 corresponds to a size which lies between zero and the maximum tightening stroke of the force amplifier. Depending on the number of axial grooves 24, the adjusting sleeve 13 can be turned to ten to twenty intermediate positions so that ten to twenty different preset clamping force settings are assumed, which lie between the minimum and maximum clamping forces. If now, in an intermediate clamping force adjustment, the tension rod 5 is moved to the left in the tightening stroke, the tension sleeve 6 can move to the left until the washer 19 bears on the stop shoulder 16. Then there follows compression of the Belleville springs 9, which is however less than in the minimum clamping force setting. The spring force created by the Belleville springs with an intermediate clamping force adjustment is correspondingly smaller. As soon as the washer 19 bears on the stop shoulder 16, the transmission of force takes place from the abutment flange 7 through the thrust bearing 8, the spacer ring 18, the retaining ring 17 and the washer 19 to the stop shoulder 16 and thence through the adjusting sleeve 13 and the fine thread 14 to the housing 1. Since however a part of the total tightening stroke of the force amplifier has already served partially to stress the Belleville springs, the residual tightening stroke leads to a smaller elastic deformation of the vise components participating in the clamping and accordingly also to a smaller clamping force, which is a combination of the force created by the elastic deformation of the vise components and the spring force created by the compression of the Belleville springs 9.

The clamping force adjusting device according to the invention can also be reversal be used with compressive spindles.

The embodiments of the invention in which an exclusive property or privilege is claimed are defined as follows:

1. A clamping force adjusting device for a clamp device having a hollow housing supported directly or indirectly on a movable clamp part, a tension rod passing through the housing and being rotatable and slidable relative thereto, a first end of the tension rod being coupled to a force amplifier and a second end carrying a tension sleeve provided with an abutment flange, the tension sleeve acting axially on the housing through an adjusting sleeve axially adjustable by means of a fine thread, a thrust bearing and a plurality of Belleville springs, wherein the abutment flange is provided on an end of the tension sleeve adjoining the second end of the tension rod and the thrust bearing is provided on a side of the abutment flange facing away from the second end of the tension rod, wherein the Belleville springs are supported directly in the housing, wherein an intermediate sleeve is provided between the Belleville springs and the thrust bearing, abutting the thrust bearing at one end and abutting the Belleville springs at an other end, and wherein the adjusting sleeve can screw into a fine thread of the housing and has a radially inwardly directed first stop member on an end facing the Belleville springs, the first stop member so cooperating with a radially outwardly directed second stop member on the intermediate sleeve and a spacer ring bearing on the thrust bearing that the axial spacing of the first stop member form the second stop member and from the spacer ring is adjustable in the unstressed state by screwing the adjusting sleeve relative to the housing, whereby the stroke of the intermediate sleeve which on tightening up to abutment of the first stop member on the second stop member and the spacer ring is adjustable.

2. The device according to claim 1, wherein the second stop member on the intermediate sleeve is formed by a retaining ring fitted in an annular groove on the intermediate sleeve.

3. The device according to claim 2, wherein the retaining ring is surrounded by the spacer ring.

4. The device according to claim 1, wherein the maximum adjustable spacing (A) between the first stop member and the second stop member is somewhat greater than the maximum tightening stroke of the force amplifier.

5. The device according to claim 1, wherenin the intermediate sleeve has a radially outwardly directed flange bearing on the Belleville springs at an end facing the Belleville springs.

6. The device according to claim 5, wherein the flange is retained on a side facing away from the Belleville springs by a retaining ring fitted in an annular groove of the housing.

7. The device according to claim 1, wherein the adjusting sleeve is retained in its current rotational position relative to the housing by a brake means.

8. The device according to claim 7, wherein said brake means further includes plural radial bores on the stop member on the adjusting sleeve, each bore having therein a detent ball and a compression spring loading the ball, and wherein an outer peripheral surface of the intermediate sleeve has a plurality of peripherally spaced, axially extending grooves for engagement with the detent balls.

9. The device according to claim 7, wherein said brake means includes spring-loaded detent balls received in grooves.

10. A clamping force adjusting device for a clamp device having a hollow housing supported directly or indirectly on a movable clamp part, a tension rod passing through the housing and being rotatable and slidable relative thereto, a first end of the tension rod being coupled to a force amplifier and a second end carrying a tension sleeve provided with an abutment flange, the tension sleeve acting axially on the housing through an adjusting sleeve axially adjustable by means of a fine thread, a thrust bearing and a plurality of Belleville springs, wherein the abutment flange is provided on an end of the tension sleeve adjoining the second end of the tension rod and the thrust bearing is provided on a side of the abutment flange facing away from the second end of the tension rod, wherein the Belleville springs are supported directly in the housing, where an intermediate sleeve is provided between the Belleville springs and the thrust bearing, abutting the thrust bearing at one end and abutting the Belleville springs at an other end, and wherein the adjusting sleeve can screw into a fine thread on the housing and has a radially inwardly directed stop member on an end facing the Belleville springs, the stop member so cooperating with a spacer ring on the intermediate sleeve bearing on the thrust bearing that the axial spacing (A) of the stop member form the spacer ring is adjustable in the unstressed state by screwing the adjusting sleeve relative to the housing, whereby the stroke of the intermediate sleeve on tightening up to abutment of the stop member on the spacer ring is adjustable.

11. The device according to claim 10, wherein the maximum adjustable spacing (A) between the stop member and the spacer ring is somewhat greater than the maximum tightening stroke of the force amplifier.

* * * * *